US006502911B2

(12) United States Patent
Fenzi

(10) Patent No.: US 6,502,911 B2
(45) Date of Patent: Jan. 7, 2003

(54) METHOD FOR THE REALIZATION OF PRINTED POLYCHROME DECORATIONS ON METAL ARTIFACTS AND RELATED APPARATUS

(75) Inventor: Giancarlo Fenzi, Cazzano di Tramigna (IT)

(73) Assignee: Comital SPA of Loc. Costeggiola S/N, Cazzano di Tramigna VR (IT)

( * ) Notice: Subject to any disclaimer, the term of this patent is extended or adjusted under 35 U.S.C. 154(b) by 114 days.

(21) Appl. No.: 09/829,002

(22) Filed: Apr. 10, 2001

(65) Prior Publication Data

US 2001/0049010 A1 Dec. 6, 2001

(30) Foreign Application Priority Data

Apr. 11, 2000 (IT) ..... MI00A0777

(51) Int. Cl.[7] ..... B41J 2/01
(52) U.S. Cl. ..... 347/1; 347/2
(58) Field of Search ..... 347/1, 2, 4, 8

(56) References Cited

U.S. PATENT DOCUMENTS 5,757,389 A * 5/1998 Schwede et al. ..... 347/4
5,790,047 A * 8/1998 Golan ..... 340/825.54
6,341,831 B1 * 1/2002 Weber et al. ..... 347/1

* cited by examiner

*Primary Examiner*—Craig Hallacher
(74) *Attorney, Agent, or Firm*—Nixon & Vanderhye P.C.

(57) ABSTRACT

A method and an apparatus for the realization of printed polychrome decorations on elongated elements (1), which allows to obtain sharper decorations to a lower cost, comprises the projection of a plurality of jets of dyeing substances through respective nozzles (2) towards external surface zones (Z1, Z2, Z3, Z4, Z5) to be decorated of said elongated elements (1) while a distance (D) is kept which is substantially constant between said zones (Z1, Z2, Z3, Z4, Z5) and said nozzles (2), also in correspondence of profile variations of said zones; besides a section bar (1) is provided having decoration zones (Z1, Z2, Z3, Z4, Z5) on its external surface showing sharp outlines and realized with various dyeing substances, such as liquid substances, liquid suspension substances, powders, and also with sublimable inks and dyes.

14 Claims, 1 Drawing Sheet

METHOD FOR THE REALIZATION OF PRINTED POLYCHROME DECORATIONS ON METAL ARTIFACTS AND RELATED APPARATUS

DESCRIPTION

The invention relates to a method for the realization of printed decorations on elongated elements, in particular rigid materials having the shape of a section bar.

In the known art methods are known for the realization of decorations on section bar elements for doors and windows which comprise the utilization of decorative transferable elements that are heat applied on the surface of a section bar element. The decorations that can be obtained through the use of such known methods have a low definition degree, as the decorative elements are transferred by sublimation from a support whereon they are applied in advance to the section bar to be decorated.

Besides, these methods involve high costs, due to the high cost of the decorative transferable elements—which must be preliminary obtained on a service support wherefrom they are subsequently transferred—and the necessity to have ovens or other heating systems suitable to contain the section bars during the sublimation of the decorative elements from the original service support.

Besides, with such methods it is difficult to decorate the surfaces of a section bar located in a marked depression or rise with respect to a face of the section bar acting as a reference plane.

It is also known how to decorate surfaces employing spray or ink jet devices provided with computer-controlled head or printing unit, and able to move along three axes orthogonal with respect to the surface to be decorated, which is kept in a fixed position. The printing head or unit is provided with nozzles through which a decorating substance is dispensed to be applied on the surface to be decorated.

With the use of such devices, it is possible to decorate substantially flat surfaces, bent surfaces having a high bending radius or also surfaces that develop on different planes, with moderate differences in height between said different planes. On the contrary, with the above decoration system it is not possible to make decorations on surfaces with a small bending radius, on surfaces that develop on planes different from each other, in particular when great differences in height exist between said different planes, nor on surfaces having a complex form. In said cases, in fact, it is not possible to maintain the spray or jet of the decorating substances projected by the printing unit in a direction substantially perpendicular to the surface to be decorated, in all the points of said surfaces, with the consequence that in the zones with a small bending radius or in the surfaces bridging different levels decoration systems for elongated elements, in particular section bars.

A further object of the present invention is to provide a system for the realization of decorations on elongated elements such as to allow the decoration of surfaces of such elements having a complex section profile, showing in particular high level alterations.

In a first aspect, the present invention provides a method for the realization of printed polychrome decorations on elongated elements through a plurality of jets of dyeing substances that are projected by the respective nozzles towards external surface zones to be decorated of said elements, characterized in that during the printing a substantially constant distance is kept between said zones and said nozzles, also in correspondence of profile variations of said zones.

In a second aspect, the present invention provides an apparatus for the realization of printed polychrome decorations on elongated elements, said apparatus comprising support means for said elongated elements, decorating means suitable to project, through the respective nozzles, a plurality of jets of dyeing substances towards external surface zones to be decorated with said elongated elements, characterized in that it also comprises distance measuring means suitable to measure the distance between said nozzles and said external surface zones and positioning means functionally associated to said distance measuring means, to position said nozzles with respect to said external surface zones.

Keeping a substantially constant distance between the nozzles dispensing the dyeing substances and the zones to be decorated allows to optimize the graphic definition of the decoration and to maintain it substantially equal throughout the decorated surface.

In a third aspect, the present invention provides an elongated element provided with decoration zones on its external surfaces, characterized in that said decoration zones have sharp outlines.

In a fourth aspect, the present invention provides an elongated element provided with decorations on zones of its external surface, characterized in that said decorations are realized with various dyeing substances, such as liquid substances, liquid suspension substances, powders or sublimable inks.

The elongated element subject matter of the present invention is selected, for instances as a metal section bar, for instance from aluminum, of big size, having in particular a length of up to 20 meters.

The invention will be now described in the following by way of non limiting example, with reference to the attached drawings wherein.

The elongated element 1 to be decorated is laid on special supports, provided in the apparatus according to the invention, and the decorating means comprising nozzles indicated as a whole by 2 and positioned at an optimum distance D from a first zone Z1 do be decorated, said distance being measured by measuring means not shown. The decorating means are mobile along three Cartesian axes X, Y and Z. Their starting positioning is made in such a ways that two of said Cartesian axes, for instance axes and Z, are parallel to the surface of the elongated element 1 in the zone Z1 to be decorated. To this aim, the elongated elements 1 can be mounted on two supports that rotate about a longitudinal axis W of said element. Alternatively, the decorating means may be caused to rotate about said W axis. The adjustment of distance D of nozzles 2 from said zone Z1 is carried out by causing the shift of said decorating means along said Y axis. The decoration of zone Z1 is then carried out by causing the movement of axes X and Z, to keep substantially unchanged distance D of nozzles 2 from said zone Z1.

The control of distance D can be obtained through sensors known per se, located near nozzles 2 on a suitable support zone.

To decorate other zones of the surface of the elongated element 1, for instance zones Z2 and Z3, the same procedure is followed as is described above, obtaining relative positions between nozzles 2 and section bar 1, indicated by A, B and C.

Figure 1:
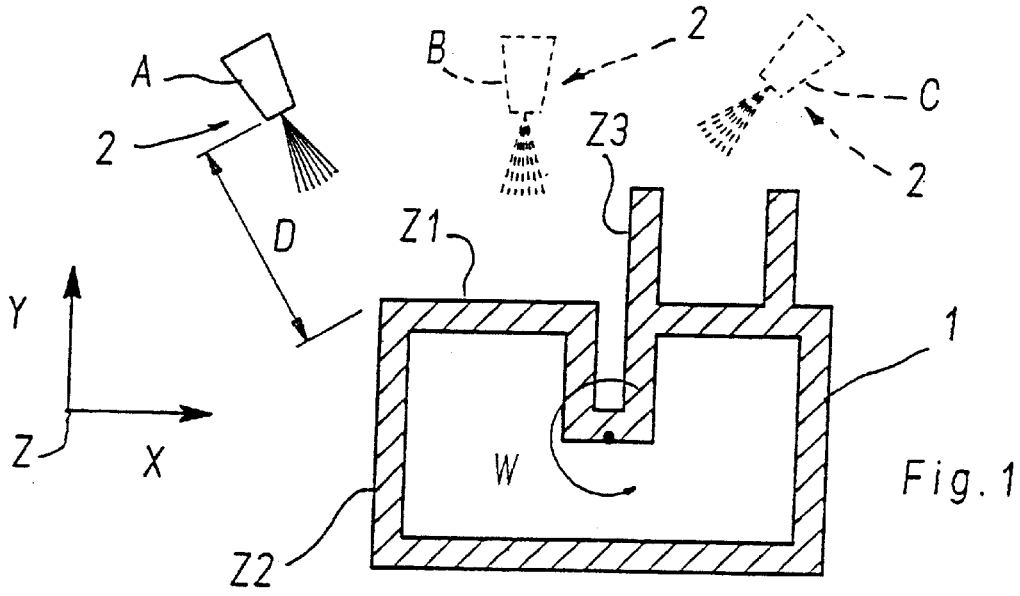
FIG. 1 is a cross-section view of an elongated element to be decorated wherein there is indicated in a very schematic manner, the nozzle dispensing dyeing substances of the apparatus according to the invention.
Figure 2:
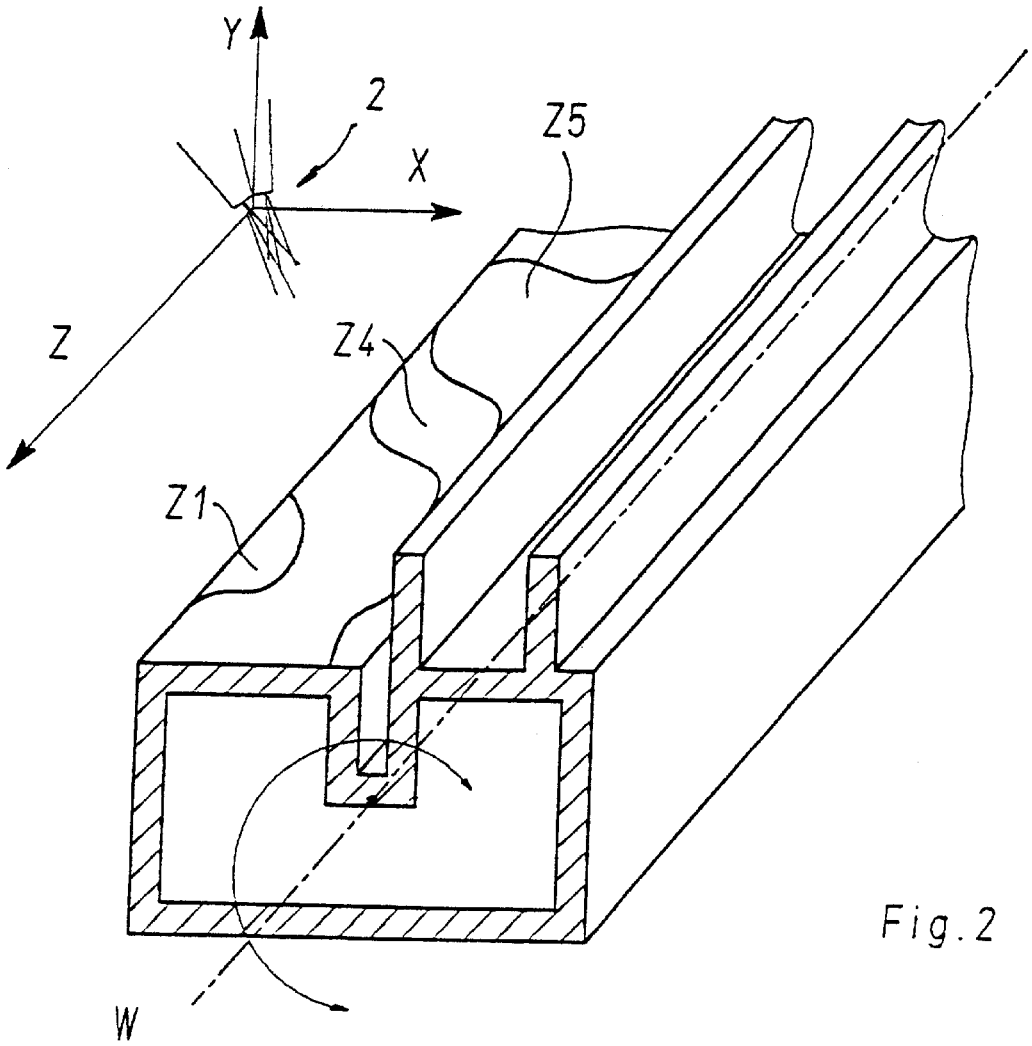
FIG. 2 is a perspective view of the elongated element wherein some external surface decorated zones are highlighted.

For instance, if one wishes to decorate zone Z2, the elongated element 1 is rotated clockwise with respect to the position shown in FIG. 1, until zone Z2 is parallel to the plane defined by the Cartesian axes X and Z. Alternatively, it is possible to rotate the decorating means counterclockwise until the plane defined by the Cartesian axes X and Z is parallel to said zone Z2. Then, the distance measuring means are activated that control the positioning of the decorating means, causing their movement along axis Y, and lastly the decoration of zone Z2 is carried out.

If a curvilinear surface zone of the elongated element 1 should be decorated, the rotation of the elongated element 1, or the decorating means, about axis W and the shifting of the decorating means along axis Y will take place also while nozzles A, B and C deliver the dying substances. Said rotation and said shift will take place in a coordinated manner based on the measurements of the distance measuring means, so that the distance of the nozzles from the surface of the elongated element 1 remains substantially constant.

What is described above may be advantageously realized with the help of programmable automation systems, based on the characteristics of the element to be decorated and the type of decoration to be obtained.

Thanks to the invention, it is possible to carry out decorations also of a complex type, maintaining an optimum image definition and obtaining sharp and well defined outlines of the decoration zones Z1, Z2, Z3, Z4, Z5. It is also possible to utilize liquid dyes, aqueous suspension dyes, powder solid dyes, sublimable colors, such as for instance acrylic, polyester, polyurethane, fluorinated dyes and the likeof.

What is claimed is:

1. A method for the realization of printed polychrome decorations on elongated elements (1) through a plurality of jets of dyeing substances through respective nozzles (2) towards external surface zones (Z1, Z2, Z3, Z4, Z5) to be decorated of said elongated elements (1), characterized in that during the printing a substantially constant distance is kept between said zones (Z1, Z2, Z3, Z4, Z5) and said nozzles (2), also in correspondence of profile variations of said zones.

2. The method according to claim 1, comprising also the measurement of said distance and the shifting of said nozzles (2) in a direction substantially perpendicular to said external surface.

3. The method according to claim 1, comprising also the carrying out of a relative rotation between said nozzles (2) and said elongated element (1).

4. The method according to claim 3, wherein said relative rotation is obtained by causing the rotation of the elongated element (1) about a longitudinal axis (W).

5. The method according to claim 3, wherein said relative rotation is obtained by causing the rotation of said nozzles (2) about a longitudinal axis (W) of said elongated element.

6. The method according to claim 1, comprising also the dispensing of said dyeing substances through said nozzles (2) by shifting said nozzles (2) in a direction parallel to a plane tangent to said surface.

7. The method according to claim 1, characterized in that said elongated elements (1) are metal section bars of a length of up to 20 m.

8. An apparatus for the realization of printed polychrome decorations on elongated elements (1), said apparatus comprising supporting means for said elongated elements (1), decorating means suitable to project, through respective nozzles (2), a plurality of jets of dyeing substances towards zones (Z1, Z2, Z3, Z4, Z5) of said external surface to be decorated of said elongated elements, characterized in that it also comprises distance measurement means of said nozzles (2) from said external surface zones (Z1, Z2, Z3, Z4, Z5), and positioning means functionally associated to said distance measuring means, to position said nozzles (2) with respect to said external surface zones (Z1, Z2, Z3, Z4, Z5).

9. The apparatus according to claim 8, wherein said positioning means are suitable to shift said nozzles (2) in a direction parallel to three Cartesian axes (X, Y, Z).

10. The apparatus according to claim 8, wherein said suspension means comprise rotation means to cause the rotation of said elongated element (1) about a longitudinal axis thereof (W).

11. The apparatus according to claim 8, further comprising rotation means suitable to cause the rotation of said nozzles (2) about a longitudinal axis (W) of said elongated element (1).

12. A section bar (1) provided with decoration zones (Z1, Z2, Z3, Z4, Z5) on its external surface, characterized in that said decoration zones (Z1, Z2, Z3, Z4, Z5) have sharp outlines.

13. A section bar (1), provided with decoration zones (Z1, Z2, Z3, Z4, Z5) on its external surface, characterized in that the decorations of said zones are realized with dyeing substances such as liquid or aqueous suspension substances or powder solid ones or ones with sublimabile colors.

14. The section bar according to claim 12, wherein said decoration zones (Z1, Z2, Z3, Z4, Z5) are obtained by means of various paints, such as acrylic, polyester or polyurethane or fluorinated paints.

* * * * *